US007784539B2

(12) United States Patent
Montaron

(10) Patent No.: US 7,784,539 B2
(45) Date of Patent: Aug. 31, 2010

(54) HYDROCARBON RECOVERY TESTING METHOD

(75) Inventor: Bernard Montaron, Paris (FR)

(73) Assignee: Schlumberger Technology Corporation, Cambridge, MA (US)

( * ) Notice: Subject to any disclaimer, the term of this patent is extended or adjusted under 35 U.S.C. 154(b) by 195 days.

(21) Appl. No.: 12/113,461

(22) Filed: May 1, 2008

(65) Prior Publication Data

US 2009/0272531 A1 Nov. 5, 2009

(51) Int. Cl.
*E21B 47/10* (2006.01)
*E21B 49/00* (2006.01)

(52) U.S. Cl. ..... 166/252.4; 73/152.39; 166/50; 166/252.1; 166/252.6; 702/11; 702/12

(58) Field of Classification Search ..... None
See application file for complete search history.

(56) References Cited

U.S. PATENT DOCUMENTS

| | | | | |
|---|---|---|---|---|
| 3,159,214 | A | 12/1964 | Carter | |
| 3,163,211 | A | 12/1964 | Henley | |
| 3,393,735 | A | 7/1968 | Altamira et al. | |
| 4,085,798 | A | 4/1978 | Schweitzer et al. | |
| 4,641,099 | A | 2/1987 | Lee et al. | |
| 5,467,823 | A | 11/1995 | Babour et al. | |
| 6,349,769 | B1 | 2/2002 | Ohmer | |
| 6,588,266 | B2 | 7/2003 | Tubel et al. | |
| 6,711,947 | B2 | 3/2004 | Maute | |
| 6,886,632 | B2 | 5/2005 | Raghuraman et al. | |
| 6,896,074 | B2 | 5/2005 | Cook et al. | |
| 2001/0036667 | A1 | 11/2001 | Tayebi et al. | |
| 2004/0129418 | A1 | 7/2004 | Jee et al. | |
| 2005/0038603 | A1 * | 2/2005 | Thomas et al. | 702/6 |
| 2007/0225916 | A1 * | 9/2007 | Jalali et al. | 702/6 |

FOREIGN PATENT DOCUMENTS

| | | | |
|---|---|---|---|
| EP | 0110750 | A2 | 6/1984 |
| WO | 9425732 | A1 | 11/1994 |

OTHER PUBLICATIONS

Ohmer, H., et al., Well Construction and Completion Aspects of a Level 6 Mulitlateral Junction, Society of Petroleum Engineers Annual Technical Conference and Exhibition, Dallas, Texas, Oct. 2000, SPE 63116, pp. 1-12.

Patent Cooperation Treaty International Search Report, Form PCT/ISA/210, Date of mailing Dec. 14, 2009, pp. 1-3.

* cited by examiner

*Primary Examiner*—George Suchfield
(74) *Attorney, Agent, or Firm*—Helen Raybaud; Vincent Loccisano; James McAleenan

(57) ABSTRACT

A method of testing the response of a subterranean formation to a formation treatment is described including the injection of a treatment fluid and the production of formation fluids from two separate boreholes or two boreholes from a single well such that the treatment fluid sweeps the formation between the two boreholes, and the use of downhole monitoring devices to determine a volume swept by the treatment fluid.

20 Claims, 4 Drawing Sheets

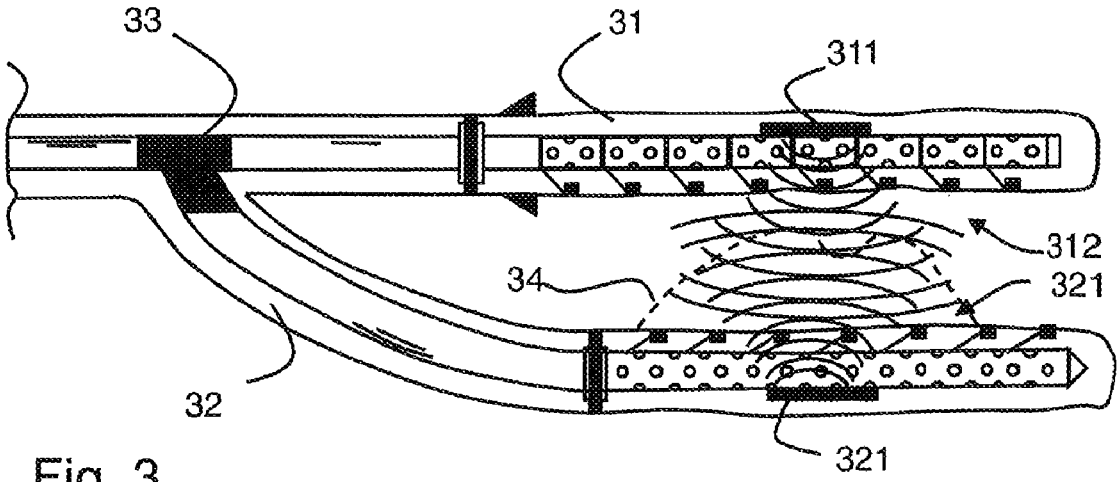
Fig. 3
Fig.4A
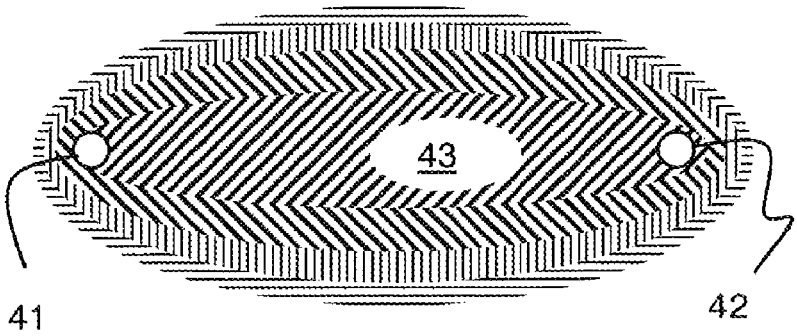

HYDROCARBON RECOVERY TESTING METHOD

FIELD OF THE INVENTION

The invention relates to a method of testing formation treatments used to recover hydrocarbons from subterranean formations and other related treatments. More specifically, the invention pertains to methods of screening and evaluating enhanced oil recovery (EOR) treatments between closely spaced wells or between laterals branching off a single well.

BACKGROUND

As hydrocarbon fields are growing more mature, the established methods of producing oil are no longer sufficient to exploit a reservoir to the extent theoretically possible. In response to this challenge a plethora of new methods have been proposed to increase recovery beyond that afforded by established methods. These methods are generally referred to as "Enhanced Oil Recovery" or EOR treatments.

Many EOR treatments make use of the injection of heat in form of heated fluids, the injection of gas (Methane, Nitrogen, Carbon Dioxide, etc.) together or alternating with water injection, or the injection of chemicals such as surfactants. Whilst a great number of such methods have been described in the relevant literature and even used in the field, it is to be expected that more and improved EOR treatments will be developed in the future.

The emergence of a multitude of EOR treatments have in common the need for thorough testing prior to large scale implementation in a reservoir. In spite of this need, testing methods have been limited in the past to laboratory test and field pilot tests.

Typically for a laboratory test, an enclosed rock core is subjected to the EOR method to be tested. Obviously, it is a very challenging task for the experimenter to emulate all downhole conditions in the laboratory and, hence, the results of such core flooding tests are often found to be only a loose indicator of the efficacy of an EOR method.

For testing under real downhole conditions, operators rely on the use of pilot tests. Typically such pilot tests are limited field deployments with for example one testing injector well and a small number of producing wells in the vicinity of the injector well, such as in a "five-spot" pattern. Given even the minimal distance between two separate wells and typical permeability values of the rock formation between these wells, it takes in most cases years before the effectiveness of an EOR treatment becomes measurable. In addition, such pilot tests require significant up-front investment in materials and equipment prior to having complete knowledge of the efficacy of the EOR treatment in question.

An early example of these methods is described in U.S. Pat. No. 3,393,735 issued to Altamira and Hoyt, whereas other examples of EOR testing include co-owned U.S. Pat. No. 4,085,798 to Schweitzer and Tapphorn, U.S. Pat. No. 5,467,823 to Babour et al. and the more recent co-owned U.S. Pat. No. 6,886,632 to Raghuraman and Auzerais, U.S. Pat. No. 6,588,266 to Tubel et al., as well as the patents and literature sources referenced in these patents.

In an effort to shorten the time required to test an EOR treatment, it has been proposed to use laterals or fractures within a well. Early examples of these single well methods are described in U.S. Pat. No. 3,159,214 to Carter and U.S. Pat. No. 3,163,211 to Henley. Further methods to place sensors in micro-boreholes drilled from the main well are described for example in co-owned U.S. Pat. No. 6,896,074 to Cook et al.

In the light of the above cited prior art, it is seen as an object of the present invention to provide improved testing methods for EOR treatments, particularly single-well and dual-well testing methods.

SUMMARY OF INVENTION

According to an aspect of the invention, a method is provided of monitoring the effectiveness of a formation treatment between two boreholes or two branches of a single well, including the steps of injecting a fluid into the injector borehole and causing a pressure gradient between the injector and producer borehole and having a monitoring device located in at least one of the two boreholes, wherein the measurements of the monitoring device are used to determine how effectively the treatment fluid has swept the formation between the boreholes, preferably by measuring changes in the formation between the two boreholes as a function of location and time.

In a preferred variant of this aspect of the invention, the treated volume between the boreholes is optimized with regard to minimizing the duration and total cost of the test and at the same time performing the test in a volume of formation that is sufficiently large to be representative of heterogeneities in the larger reservoir. Thus, the distance between the two wells cannot be chosen arbitrarily small or large. The radial nature of the flow around the injector and around the producer well must also be taken into account. It is known that the average fluid velocity in a porous medium is inversely proportional to the distance r from the well, while at the same time having a large effect on an EOR recovery factor or recovery rate.

The preferred dimensions of the wells are chosen such that the size of the tested volume is several times larger than the characteristic dimensions of the heterogeneity of the reservoir. Thus any heterogeneity contributes preferably only in an averaged manner to the result of the test. The length l of the active sections of the boreholes is hence for most formations in the range of about 10 meters to 1000 meters. The active or drain section is defined as the section of the injector borehole into which fluids are either injected into the formation or—in the producer borehole—from which the fluids are produced during the testing. The average distance d between the active sections of the two boreholes is preferably about 100 meters or less to 10 meters. In a further preferred variant, the parameters d and l are chosen to be within 10 percent of each other. In another preferred variant of the invention, the length l is chosen to be between 1 and 10 times the average distance d.

In yet another preferred embodiment of this aspect of the invention, the dimension of the active sections are chosen such as to make sure that one pore space of volume expected to be swept is likely to be replaced by the injected fluid in a time period of less than six months or, more preferably, less than 4 months.

According to another aspect of the invention, a method is provided of monitoring from a single well the effectiveness of a formation treatment with two boreholes branching off the single well.

One of the two boreholes can be the main well, which extends to the surface, whilst the second can be a lateral borehole sidetracked from the main well. Alternatively the second borehole can be a microborehole as described for example in U.S. Pat. No. 6,896,074 referenced above. In another variant, the two boreholes can be two laterals or two microboreholes branching off the same well. The two boreholes can also be a pair of a multitude of such boreholes.

In a preferred embodiment of the invention the two boreholes are at least temporarily equipped with tubing to allow the injection of fluid into one branch and the production of fluid from the second branch.

In another preferred embodiment, one of the boreholes is at least temporarily equipped with one or more monitoring devices which are capable of measuring the change of a parameter as a function of location and time. In other words, the tool is capable of measuring continuously, quasi-continuously, or in time-lapse manner a space-resolved map of the parameter in question in a plane or volume of the formation between the two boreholes.

In a preferred variant of this embodiment, the monitoring devices have a depth of investigation (DOI) of at least 50 cm, more preferably of at least 1 m, or even more preferable of 5 or more meters into the formation. In an even more preferred variant of this embodiment, the monitoring devices are part of an array tool including a plurality of equal or similar sensor elements distributed along the length of the borehole.

This embodiment has the advantage of providing sufficient measurements to observe heterogeneities within the formation and hence has the potential of delivering a more accurate assessment of the efficacy of the planned treatment within a larger section of the formation in a process which is referred to within the scope of the present invention as "upscaling" process.

In a variant of this invention, the measurements of the monitoring devices or sensing tool is used to provide an input to a model or simulation program which is designed to calculate the volume swept by an EOR treatment and produced through one of the boreholes. It is expected that in most cases the measurements will not be sufficient to generate an accurate determination of the volume affected by the treatment and the amount of fluids produced from such volume. In these cases, it is advantageous to use the measurements to constrain a simulation which models the formation and the fluid flow between the two boreholes. As such a simulation concerns a part of the reservoir, it is envisaged that standard reservoir simulators such as ECLIPSE (TM of Schlumberger) can be readily adapted for such modeling. Alternatively, it is possible to use simplified variants of reservoir simulators.

Whether being the result of a direct measurement or the result of combining the measurement with a simulator, it is another aspect of the present invention to provide a measurement of the volume swept by the EOR treatment tested and a measure of the volume and composition of fluids produced as a result of this treatment. These measurements can be performed at the surface or at a downhole location. These measurements are preferably used to determine a recovery rate associated with the EOR method tested. Whilst there are many different ways of defining a recovery rate, it is essentially a number representative of the increase of production attributable to the EOR treatment tested with respect to a standard treatment or no treatment.

Yet another aspect of the invention relates to the beneficial effects gained by applying the above methods. Using the method, new EOR treatments can be tested and existing EOR treatments can be improved and fine-tuned to match the properties of the formation to which they are applied. The methods in accordance with this invention can also be used to estimate the incremental recovery rate of hydrocarbons assuming a full-scale application of the EOR treatment tested within the reservoir.

These and other aspects of the invention are described in greater detail below making reference to the following drawings.

BRIEF DESCRIPTION OF THE FIGURES

FIG. 3 shows another example of an embodiment of the invention; and

FIGS. 4A to 4D illustrate examples of the use of a reservoir model for the purpose of one embodiment of the present invention.

DETAILED DESCRIPTION

Figure 1:
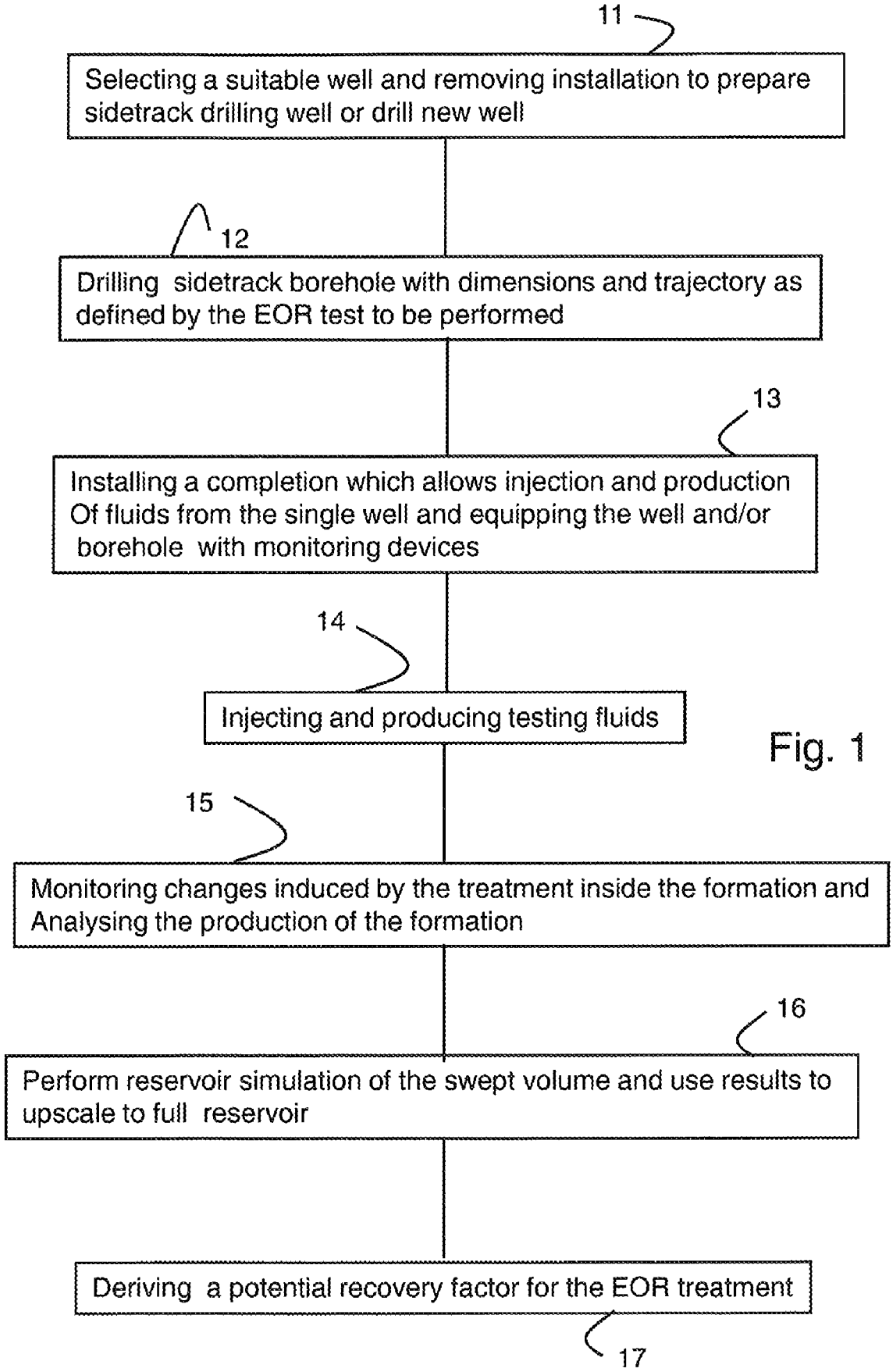
FIG. 1 is a flow diagram illustrating steps in accordance with an example of the present invention.
Figure 2:
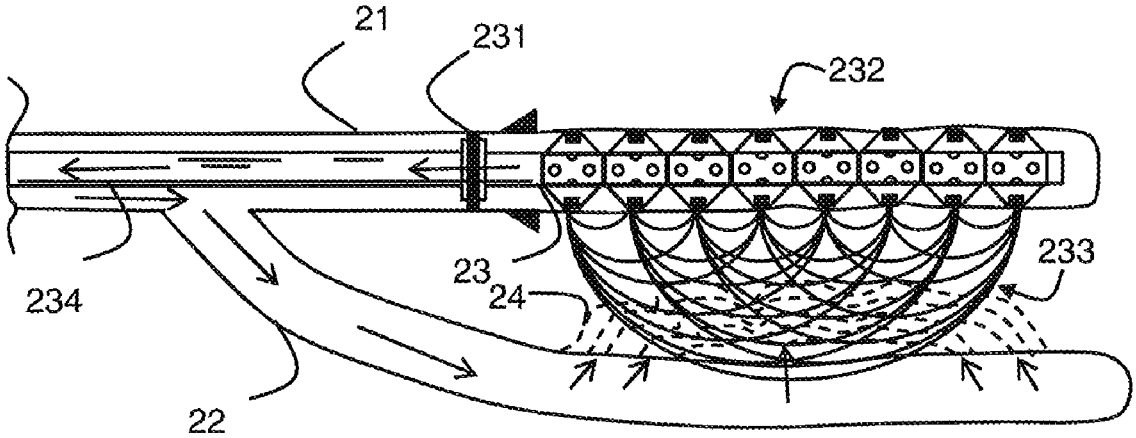
FIG. 2 shows an example of one embodiment of the present invention.

The following example describes a method in accordance with one embodiment of the present invention using the block diagram of FIG. 1 and the drawing of FIG. 2. The example is based on the presence of an existing well.

In a first step 11, an existing well 21 is selected. The selection process is important as some of the measurements described below can be simplified through a good choice of a well. It is advantageous to select an old producing well in a zone completely swept, e.g., after water breakthrough. Typically the residual oil saturation around an injector well is not representative of the remaining oil saturation in most parts of a swept zone. The oil recovery achieved at this stage of the life of a producing well is close to the maximum reachable under plain sea-water injection or whatever injection fluid was used. Testing the EOR treatment as described below then provides a direct quantitative measurement of the incremental oil recovery that can be obtained by the tested treatment. After choosing an existing well, any completion (e.g. production tubing) which prevents a re-entry and drilling of a lateral borehole are removed from the selected well 21. Alternatively, a new well can be drilled.

As shown in FIG. 2, after the preparation of the well 21 an open hole leg 22 is drilled (Step 12 of FIG. 1) using standard sidetrack drilling technology and for example a rotary steerable drilling system. Such systems as embodied by Schlumberger's Powerdrive™ systems are well known. The exact geometry and trajectory of the sidetracked borehole 22 is to a large extent determined by the EOR method to be tested, the time scale proposed for the tests and the amount of material to be used for the test. All these parameters influence the volume of rock that will be swept by the fluid to be injected through the sidetracked borehole 22 and the amount of fluid produced through the parent well 21.

The sidetracked borehole 22 is drilled to run in parallel or at least at a sharp angle of less than 90 degrees to the main well 21. The average distances between the two boreholes 21, 22 can be in the range between 3 m and 100 m. These distances translate into observation times of several months to several weeks or even less.

In case where drilling costs are not a dominant factor, it is possible to replace the above steps by the steps of drilling two separate wells which are very closely spaced in the target region of the reservoir. The average distance d between the active sections of the wells is also typically in the range of 3 m or 10 m to about 100 m.

For both variants the optimal length of the active section is likely to be between 10 m or 100 m and 1000 m to ensure that any heterogeneity in the reservoir is sufficiently averaged for the purpose of the testing.

After the drilling of the borehole 22, a completion 23 is designed and installed (Step 13) to inject a treating fluid through the annulus and to produce it through the tubing. The completion 23 includes a packer 231 to isolate the producing and injection boreholes. In the example, the completion further includes an electro-magnetic array device 232 installed for the duration of the test as a monitoring device. The device 232 is controlled and its measurements monitored from surface using a cable 234.

A resistivity array such as the tool 232 shown in FIG. 2 uses multiple electrodes or, in an alternative example, inductive elements individually controlled to generated focusing currents and measuring currents in the formation. Such resistivity array tools are now used frequently as logging tools. Standard array tools such as Schlumberger's HRLA tool are routinely capable of measuring the resistance at various radial depth levels. The distances between the electrodes or induction coils can be varied to enable a sufficiently deep penetration of the sensing field 233 into the formation of 1 meter and more. The result of such measurements is a three-dimensional map of the resistivity distribution around the borehole 21.

Instead of deploying a permanently installed tool 232 as shown, it is also possible to use through tubing variants of standard array or other logging tools to perform measurements in a time-lapse manner.

Additional or complementary measuring devices can be installed either downhole or at the surface. As such it is advantageous to install flowmeters to monitor the flowrates and/or composition of the various phases injected and produced. The producing well can include for example a surface multi-phase flowmeter (not shown) for monitoring the composition and/or flow rates of the produced fluids using a multi-phase meter such as provided by Schlumberger under the trademarks PhaseTester or PhaseWatcher. Further sources or receivers for the sensing field 233 can be installed either on the surface or in neighboring wells.

After the preparatory steps 11-13, the actual testing of an EOR treatments starts by injecting the EOR treatment fluid(s) or fluid sequence through the annulus into the borehole 22 and producing fluids through the well 21 (step 14 of FIG. 1). These fluids can be of different nature and composition including but not limited to the group consisting of water (fresh or saline), gas (CO2, CH4, flue gas, mixtures), foam, steam, water with chemicals (alkali, polymers, surfactants, or mixtures), or foam with chemicals.

During the step of injecting and producing of the testing fluids, the monitoring tool 232 is set up to monitor any changes in the formation between the borehole 22 and the main well 21. Changes in the composition of the fluids produced (Step 15 of FIG. 1) are monitored simultaneously. A possible time-lapse measurement of the fluid front of the injected EOR fluid is shown in FIG. 2 as a series of dashed lines 24. The readings of the resistivity array device 232 can be used to determine a resistivity map in either a 2D slice or 3D volume of the formation between the borehole 22 and the main well 21.

In place of the resistivity array, which is sensitive to the electromagnetic field in the formation, it is feasible to install other suitable tools, based on different physical principles and hence being sensitive to different fluid and formation such as sonic array tool which detect acoustic waves in the formation. Particularly for the purpose of monitoring gas injection fronts, which have a high contrast in acoustic impedance, sonic or even seismic arrays may be more effective than electromagnetic tools. An array of sensors, such as hydrophones or geophones can be placed in either borehole to passively monitor the progress of the fluid fronts.

Another method is to run at different times, for example in weekly intervals, a SonicScanner (TM of Schlumberger) logging tool in one well—typically through the branch the most easily accessible by a logging tool—and to process the data in order to observe the gas front progression 24.

In FIG. 3 there is shown another example of the invention with a completion in both boreholes 31, 32. Such completions are known and can be built to the desired degree of level. See, for instance, co-owned U.S. Pat. No. 6,349,769 to H. Ohmer and the SPE publication SPE 63116 "Well Construction and Completion Aspects of a Level 6 Multilateral Junction" October 2000 that describe suitable completions at TAML level 6 and are incorporated herein by reference. The Y-junction 33 includes tubing to inject fluid into one of the boreholes 31, 32 and withdraw fluids from the other. This tubing can be either permanently installed or either injection or withdrawal is achieved by inserting a coiled tubing with an appropriate packer into one or the boreholes branches 31, 32. The completion in both boreholes further include acoustic sources 311, 321 and acoustic receiver arrays 312, 322. These measuring devices are designed to detect the moving front of a gas injection 34 between the two wells.

However, in other cases it may be easier to adapt standard seismic methods such as VSP (vertical seismic profiling) and place a controlled seismic source in the other boreholes or on the surface to generate the acoustic energy which is then reflected from the fluid front and registered by the array tools.

In another example (not shown), the injector borehole is divided into a number of zones/sections, and, while an EOR fluid is injected it is marked by specific tracers with unique characteristics for each zone/section. The tracers are immobilized or placed on the completions in each zone/section. The tracers are specific or introduced to give specific information from each zone/section. Such methods are described as such in the U.S. Published Patent Application No. 2001/0036667 and the prior art cited therein. A location specific measurement of the EOR fluid front can be made using a device which is capable of measuring a concentration profile for each tracer along the length of the producer borehole using again either an array of stationary sensors mounted on the completion or a logging tool which is moved along the wall of the producing borehole. This method can be used to define an approximate fluid front profile.

In many cases, the depth of investigation of any of the above methods or equivalent methods may not be sufficient to cover the entire region or volume between the two boreholes. While the efficiency of an EOR method can be estimated from measurements made in just a part of the swept volume, it is more accurate to consider the total swept volume in relation with the total production from such volume (Step 16 of FIG. 1). To perform a more accurate determination of the recovery rate of a tested EOR method, it is thus seen as advantageous to use the measurements made downhole or on the surface as input to a reservoir model which in turn delivers an estimate of the parameters sought (Step 16 of FIG. 1).

Thus, the calculation of recovery factors and determination of other formation parameters can in many cases rely on the use of a simulation model or a reservoir modeling software such as Schlumberger's ECLIPSE™ or any equivalent reservoir simulation program, or, alternatively, a combination of a modeling software and a reservoir simulator. The input to the simulator is generally the geometry of the boreholes and any measurements that can be made to determine the geology, lithography, porosities, saturations and the flow paths of the fluids in the formation and the measurements such as the resistivity maps as measured in the above example.

Even if based solely on the geometry and other predetermined knowledge of the boreholes and pressures in the borehole, i.e., parameters which are measureable within the boreholes, the use of a reservoir simulator can already assist in identifying at least a central corridor of swept formation.

Figure 4B:
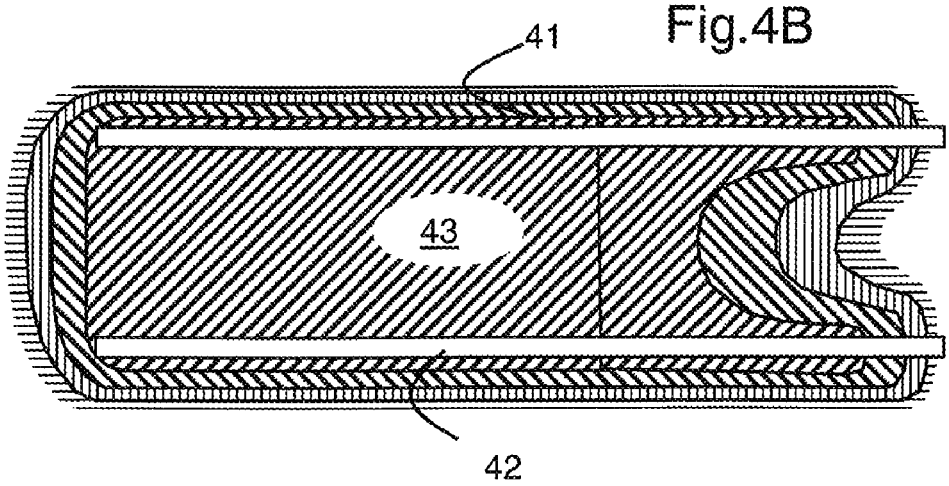

An example is shown in FIGS. 4A and 4B, which illustrate a model derived solely from parameters measureable inside the boreholes and the known geometry (trajectories, diameter etc) of the boreholes in a horizontal and vertical cross-section, respectively. The volume between the two boreholes 41, 42 shows zones which are uniformly swept and it is possible to determine the recovery achieved in the most swept cells in the central zone 43 to improve the accuracy of any prediction made on the performance of an EOR method.

Figure 4C:
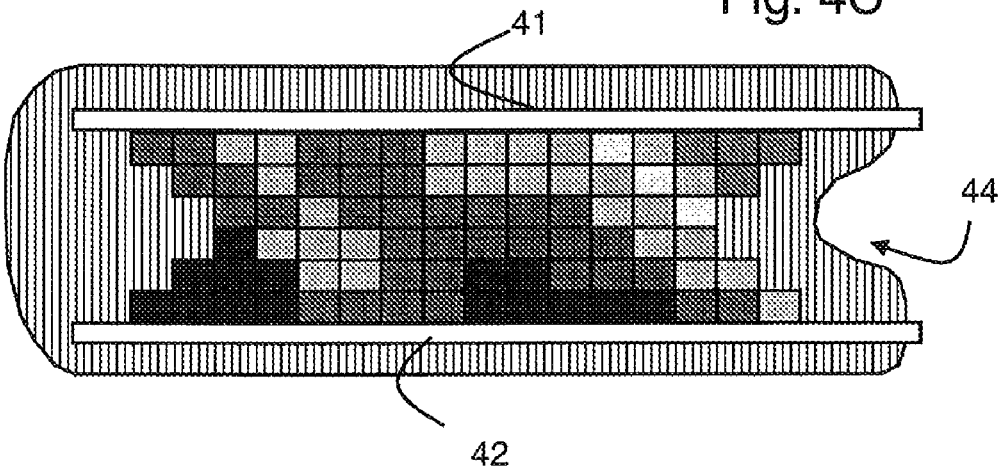

However the accuracy of such prediction can be significantly increased taking into consideration the measurements described above, each of which providing constraints to render the simulation of the inter-well volume more realistic. In FIG. 4C, it is assumed that the sweep rate for the volume between the two boreholes 41, 42 is measurable using a cross-well tomography method. The crosswell tomography based on inductive sensors as described above is capable of mapping the resistivity in the space between both boreholes at a resolution represented by the size of the cells 44. The brightness of each cell is taken to be inversely proportional to the rate at which it is swept by the EOR treatment.

Figure 4D:
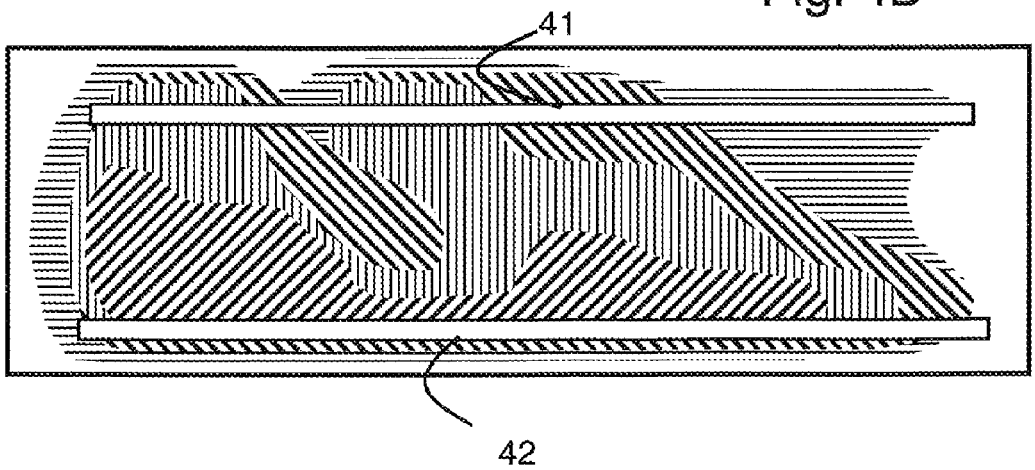

When using these measurements to constrain the reservoir model, it is possible to arrive at a more accurate determination of the swept volume. The simulation performed with such constraints results in an image as shown in FIG. 4D. The measured data is used as an indicator of the sweep efficiency for grid cells and compared to what would be obtained at this stage of the injection process—i.e. for the same total volume of fluid injected so far—assuming a constant permeability distribution. The data is then inverted to change the permeability map in order—for example—to increase the permeability in zones that are poorly swept compared to the uniform assumption. From there a more realistic simulation can be run using the reservoir simulator that matches closer the observed data.

The injected and produced volumes of oil, gas, water can be measured accurately on surface. Using the simulator, it is possible to model the formation volume that is swept with the amount of treating fluid going in various zones as calibrated by measurements made. The recovery factor can then be estimated (Step 17 of FIG. 1) for the center of the swept zone so as to provide a number that can be used for estimating recovery at a larger scale (full size pilot, or full field implementation).

Whilst the use a flow simulator or reservoir simulator as described above will provide more accurate result, it is possible to illustrate the method using a simplified numerical example. Assuming thus that the treatment fluid swept a volume V(sweep) within the volume accessible to the resistivity monitoring tool and produced a total of P(EOR) of hydrocarbons as measured by the flowmeter. The incremental recovery factor R(EOR) and hence the efficacy of the EOR treatment can be determined using for example P(EOR)=V(sweep) *Porosity*R(EOR) with Porosity being a measure of the pore volume filled with hydrocarbon and formation water. To evaluate an EOR treatment can then be based on a comparison between the measured incremental recovery rate R(EOR) with any given prior recovery rates.

Given the above measurements, it is possible to decide for example whether a treatment which changes the wettability of the formation results in an improved recovery rate or make similar decisions relevant to the production of a hydrocarbon reservoir.

The importance of identifying a core area or volume between the boreholes on which to base the testing of the EOR becomes apparent when looking at the volume of swept formation versus the volumes unswept or only partially swept, as shown for example in FIG. 4D. For the sake of simplicity, the effects of unswept or partially swept volumes, of inhomogeneous pressure gradients between the boreholes etc., are collectively referred to as "edge effects". When upscaling these results to the full field EOR simulation it is important to consider the "edge effects" that are present due to the limited scale of the EOR characterization through tests in accordance with the present methods. Typically and as shown for example in FIG. 4D about 50% of the volume between the two boreholes 41, 42 may be subject to such edge effects.

This level of heterogeneity observed in the data between the two boreholes has to be considered during the upscaling process, which translates the results gained from the above-described EOR testing to a realistic estimate of the performance of the EOR method on a reservoir scale. On a reservoir scale, EOR methods are applied to injector and producer wells separated by distances of 100 or more meters at the surface. Upscaling based on EOR testing results gained from integral or average values for the total area or volume between the two boreholes 41, 42 would give the edge effects a high weight. Typically at the full reservoir scale the non-edge zones cover a much larger fraction of the total reservoir volume (more than 90%). Therefore the recovery factor applied to the reservoir is advantageously based on the non-edge zone of the reduced scale experiment.

In the following, a conventional pilot test is compared with the new mini pilot test of the present invention. Assuming horizontal injectors and producers of active length l=1000 m, and a distance between the two wells of d=500 m. Assuming further that the two wells are parallel and the reservoir thickness is e=20 m with a porosity $\phi$=25%, one pore volume of fluids is equal to $$V=edl\phi \quad [1].$$

The EOR fluid injected—for example sea water with surfactants—does not displace completely the fluids contained in the pore space. For example, fluids in micro-pores are likely to be non-mobile such that only a fraction f of the porosity will be displaced. Not all the fluid injected through the injector will go to the producer, some of it may flow in the opposite direction. The fraction of fluid flowing from the injector to the producer is assumed to be x. This number depends on the geometrical configuration of the wells in the reservoir, on the permeability distribution, and the pressure distribution. Assuming a total flow rate injected Q=1500 m3/day, the total pumping time T corresponding to one pore volume (1) is given by [2]:

$$T \approx \frac{edLf\phi}{xQ}. \quad [2]$$

Using the numbers above, x=0.7 and f=0.6, the duration T equals 1428 days, i.e. close to 4 years. The total volume injected during that time is equal to TQ=2.14 million m3.

The cost of the pilot test is a direct function of the test duration and of the total volume of fluids injected. For example assuming a concentration c=1% for chemical additives (e.g. surfactants) and a cost for chemicals of p=2000 USD/m3, the total cost of chemicals is pcTQ=43 million USD.

Comparing these figures with a mini pilot study as proposed by the present invention yields the following savings in execution time and costs:

In a mini pilot, typical dimensions are l=100 m, d=40 m, and the flowrate are equal in proportion to the active length of the injector, i.e. Q=1500×100/1000=150 m3/d.

With all other parameters remaining identical, a total pumping time T=114 days, i.e. 3½ months, is derived from equation [2]. The total volume injected would be TQ=17143 m3 and the cost of chemicals would be pcTQ=343,000 USD. Thus, the time is reduced by a factor of 12.5, and the total volume injected and chemical cost is reduced by a factor of 125.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative processes, one skilled in the art will recognize that the system may be embodied using a variety of specific procedures and equipment and could be performed to evaluate widely different types of applications and associated geological intervals. Accordingly, the invention should not be viewed as limited except by the scope of the appended claims.

What is claimed is:

1. A method of testing the response of a subterranean formation to a formation treatment, comprising the steps of injecting a treatment fluid in an injector borehole and producing formation fluids from a producer borehole with the injector borehole and producer borehole being boreholes branching off a single well such that the treatment fluid sweeps a volume of the formation between the injector and producer boreholes;

deploying one or more downhole monitoring devices; and using the devices to determine how effectively the treatment fluid has swept the formation between the boreholes.

2. A method in accordance with claim 1, wherein the step of determining how effectively the treatment fluid has swept the formation between the boreholes includes the step of determining the volume of the formation swept by the treatment fluid and produced from the producer borehole.

3. A method in accordance with claim 1, wherein at least part of the downhole monitoring devices are permanently installed for a duration of the testing in at least one of the boreholes.

4. A method in accordance with claim 1, wherein the devices are used to measure changes caused by the treatment fluid within the formation.

5. A method in accordance with claim 1, wherein the devices are used to monitor changes caused by the treatment fluid within the formation in a distance of at least 30 cm from the boreholes.

6. A method in accordance with claim 1, wherein the devices are used to measure changes caused by the treatment fluid within the formation in a distance of at least 1 m from the boreholes.

7. A method in accordance with claim 1, wherein the devices are used to monitor changes in an electro-magnetic response of the formation caused by the treatment fluid within the formation.

8. A method in accordance with claim 1, wherein the devices are used to monitor changes in an acoustic response of the formation caused by the treatment fluid within the formation.

9. A method in accordance with claim 1, further including the step of determining the flow rate and composition of fluid produced from the producer borehole.

10. A method in accordance with claim 1, further including the step of determining the flow rate of fluid injected into the injector borehole.

11. A method in accordance with claim 1, further including the step of determining the flow rate of fluid injected into the injector borehole and determining the flow rate and composition of fluid produced from the producer borehole.

12. A method in accordance with claim 1, wherein the devices are used to release a plurality of tracers added to the treatment fluid at a corresponding plurality of locations in at least one of the two boreholes.

13. A method in accordance with claim 1, further including the step of determining a parameter indicative of a volume of hydrocarbon produced relative to a total volume of hydrocarbon in the volume swept.

14. A method in accordance with claim 1, further including the step of using measurements of the downhole devices as input to a reservoir simulation of the swept volume.

15. A method in accordance with claim 1, further including the step of using measurements of the downhole devices as input to a reservoir simulation of the swept volume and using the results of the simulation to upscale the testing to the reservoir to determine a recovery factor for an EOR treatment of the reservoir.

16. A method in accordance with claim 1, further including the step of using the measurements to exclude parts of the swept volume for the purpose of determining how effectively the treatment fluid has displaced hydrocarbon.

17. The method of claim 1, wherein the formation is swept in a volume limited by an active section of each of the two boreholes and the active section have an average distance in the range of 10 to 100 meters.

18. The method of claim 1, wherein the formation is swept in a volume limited by an active section of each of the two boreholes and the active sections have an average distance in the range of 10 to 100 meters and the active sections have a length in the range of 10 to 1000 meters.

19. The method of claim 1, wherein the formation is swept in a volume limited by an active section of each of the two boreholes and the active sections have an average distance and length chosen such that one pore volume of a volume expected to be swept corresponds to less than six months of injection.

20. The method of claim 1, wherein the formation is swept in a volume limited by an active section of each of the two boreholes and the active sections have an average distance and length chosen such that the volume is swept in less than four months.

* * * * *